US011204178B2

(12) United States Patent
Mak

(10) Patent No.: US 11,204,178 B2
(45) Date of Patent: Dec. 21, 2021

(54) RANGE HOOD HAVING AN INTERNAL CIRCULATION FILTER FOR COOKING FUMES

(71) Applicant: JIANGMEN YINXING ROBOTICS LIMITED, Guangdong (CN)

(72) Inventor: Hin Yu Mak, Guangdong (CN)

(73) Assignee: JIANGMEN YINXING ROBOTICS LIMITED, Guangdong (CN)

( * ) Notice: Subject to any disclaimer, the term of this patent is extended or adjusted under 35 U.S.C. 154(b) by 0 days.

(21) Appl. No.: 16/755,599

(22) PCT Filed: Nov. 1, 2018

(86) PCT No.: PCT/CN2018/113527
§ 371 (c)(1),
(2) Date: Apr. 13, 2020

(87) PCT Pub. No.: WO2019/085976
PCT Pub. Date: May 9, 2019

(65) Prior Publication Data

US 2021/0199308 A1 Jul. 1, 2021

(30) Foreign Application Priority Data

Nov. 2, 2017 (CN) ..... 201711065815.8

(51) Int. Cl.
*F24C 15/20* (2006.01)

(52) U.S. Cl.
CPC ..... *F24C 15/2035* (2013.01); *F24C 15/2028* (2013.01)

(58) Field of Classification Search
CPC ..... F24C 15/2028; F24C 15/2035
See application file for complete search history.

(56) References Cited

U.S. PATENT DOCUMENTS

2004/0035411 A1* 2/2004 Livchak ..... F24C 15/2035 126/299 R
2013/0087134 A1* 4/2013 Mikulec ..... F24C 15/2021 126/299 D

FOREIGN PATENT DOCUMENTS

| | | | |
|---|---|---|---|
| CN | 102261690 | A | 11/2011 |
| CN | 202973262 | U | 6/2013 |
| CN | 205137601 | U | 4/2016 |
| DE | 202015104361 | U1 | 11/2016 |
| DE | 102016113356 | A1 | 2/2017 |

* cited by examiner

*Primary Examiner* — Alfred Basichas

(57) ABSTRACT

A range hood having an internal circulation filter for cooking fumes comprises a back cover (1). A suction block (2) is provided inside the back cover (1), and a blower (3) provided inside the suction block (2) is used to achieve adsorption of cooking fumes. The back cover (1) is further provided with a filtration device (4) in communication with an air outlet of the blower (3), and used to filter the cooking fumes. An internal circulation block (5) is connected and sealed to an air outlet end of the filtration device (4), so as to achieve internal circulation of filtered gasses. The range hood having an internal circulation filter for cooking fumes features a simple structure, and extends the service life of a range hood. The invention effectively absorbs excess heat in a kitchen, thereby lowering the internal ambient temperature of the kitchen.

8 Claims, 2 Drawing Sheets

RANGE HOOD HAVING AN INTERNAL CIRCULATION FILTER FOR COOKING FUMES

TECHNICAL FIELD

The invention relates to the technical field of range hood, in particular to a range hood which adopts a filtration device to filter cooking fumes and discharge cooking fumes in an internal circulation flowing mode indoors to replace a traditional channel to discharge the oil smoke outdoors.

BACKGROUND ART

With the continuous growth of economy and the continuous promotion and improvement of people's living standards, kitchen range hoods have become a necessity for people's lives. However, due to the short development time of range hood, the products thereof in the existing market mainly focus on smoke exhaust, and there is little consideration of energy saving and environmental protection, smoke from people's daily life and cooking causes serious pollution to outdoor and indoor environments; the domestic range hoods in the prior art are mostly external exhaust type, which directly exhaust the smoke into the atmosphere, and there is secondary pollution of oil and smoke, the technology of internal exhaust type range hood is extremely rare in the market.

Therefore, to solve the shortcomings of the prior external exhaust type range hoods, some internal exhaust type range hoods have gradually emerged in recent years, and most of this kind range hoods are used the technology that separating the oil and smoke and discharging into kitchen to realize internal circulation. Most of the oil-smoke separation technologies adopt purification treatments such as activated carbon and centrifugal separation, however, the structure of the purification treatment device is complicated, the cost is too high, the service life is short, and the device needs to be replaced frequently.

In addition, because the effective utilization rate of combustion heat of the gas stove on the existing market is mostly between 40% and 50%, the rest heat, namely the waste heat, is dissipated to the space of a kitchen, the waste heat can not be effectively absorbed or discharged, the indoor temperature can be greatly improved, and the using effect of other indoor household appliances is reduced. The purification device of the inner exhaust type range hood on the market only has the function of separating oil and smoke, does not have the functions of absorbing heat and cooling, and cannot realize effective discharge or cooling of waste heat in a kitchen space; moreover, the grease clouded in the cooking fumes not only contaminates the blower and air ducts, but also hinders the purification of harmful gases by the purification materials.

SUMMARY OF THE INVENTION

In order to solve the disadvantages and defects in prior art mentioned above, the invention provides a range hood having an internal circulation filter for cooking fumes, the cooking fumes sucked by the range hood is filtered by liquid, and is separated by liquid, oily components are mixed into the liquid, the separated gas is discharged from the liquid and enters the range hood, an one-way air curtain is adopted to separate air outside the range hood body and gas in the internal circulation block of the range hood, thereby realizing the internal circulation flow of the air in the range hood, and relatively clean air in the range hood can be discharged out of a room from a gap of a range hood assembling parts, the one-way air curtain replaces the required pipeline in traditional external exhaust and reduces the air pollution; the range hood can be directly arranged indoors, and the defect that a pipeline through hole needs to be formed in a kitchen wall or a glass window for pipeline discharge of the external exhaust range hood is overcome. In addition, the adoption of liquid for filtering the oil and smoke can absorb heat and reduce the temperature of waste heat generated by cooking in a kitchen and then discharge the waste heat into a room, and the temperature of the kitchen is effectively reduced; therefore, the range hood having an internal circulation filter has the advantages of being simple in structure, simple to use, safe, convenient, free of cleaning, not prone to blocking, good in fume filtering effect, free of peculiar smell of exhaust gas after filtering, environment-friendly, capable of reducing troubles of disassembling and washing the range hood, low in cost and the like, and it extends the service life of the range hood, thoroughly purifies the oil smoke gas, effectively absorbs excess heat in a kitchen, thereby lowering the internal ambient temperature of the kitchen, and greatly meets the living requirements of different families.

In order to solve the technical problem in the prior art, the invention adopts following technical schemes: a range hood having an internal circulation filter for cooking fumes, comprising a back cover, a suction block is provided inside the back cover, and a blower provided inside the suction block is used to achieve adsorption of cooking fumes, the back cover is further provided with a filtration device in communication with an air outlet of the blower, and used to filter the cooking fumes, an internal circulation block is connected and sealed to an air outlet end of the filtration device to achieve internal circulation of filtered gasses.

Further, circulating line connected with an air outlet end of the filtration device is provided in the internal circulation block.

Further, the filtration device comprises a filtration tank containing liquid to realize oil smoke filtration.

Further, blower wheel chassis is provided below the suction block, an air drum, communicated with an air duct of the blower and used for guiding wind direction, is arranged inside the the blower wheel chassis, and an air drum connection pipe is provided in the blower wheel chassis between the air drum and the filtration tank to realize the oil smoke enters the liquid in the filtration tank from the air drum.

Further, the blower wheel chassis is provided with a filtration box between air outlet end of the filtration tank and air inlet end of the internal circulation block.

Further, a liquid-proof batten is provided between the blower wheel chassis and the filtration tank to achieve isolation of blower wheel chassis from liquid contamination in filtration tank.

Further, baffle blocks are provided on two sides of top portion of the filtration tank, which are used for preventing the liquid in the filtration tank from splashing caused by overlarge air inlet amount of the blower and isolating the oil concentrated on the two sides of the filtration tank from the water in the middle.

Further, the internal circulation block is provided with one-way air curtain used for separating air outside the range hood body and gas in the internal circulation block of the rang hood.

Further, the liquid contained in the filtration tank is water.

Further, the filtration tank is provided with a liquid-discharge valve port for removing oil and sewage and a water filling pipe for injecting new water into the filtration tank.

Further, the liquid in the filtration tank is mixed with more than one of the deodorant, detergent or degreaser, or any other additives capable of achieving the same cleaning and filtering functions of smell removal, oil removal and the like can be adopted; in the same way, a filter for removing smell and/or removing oil can be arranged in the filtration box, the same function or the the secondary optimization function can be achieved.

The advantageous effects of the invention are as follows: the invention provides a range hood having an internal circulation filter for cooking fumes, the cooking fumes sucked by the range hood is filtered by liquid, and is separated by liquid, oily components are mixed into the liquid, the separated gas is discharged from the liquid and enters the range hood, an one-way air curtain is adopted to separate air outside the range hood body and gas in the internal circulation block of the range hood, thereby realizing the internal circulation flow of the air in the range hood, and relatively clean air in the range hood can be discharged out of a room from a gap of a range hood assembling parts, the one-way air curtain replaces the required pipeline in traditional external exhaust and reduces the air pollution; the range hood can be directly arranged indoors, and the defect that a pipeline through hole needs to be formed in a kitchen wall or a glass window for pipeline discharge of the external exhaust range hood is overcome. In addition, the adoption of liquid for filtering the oil smoke can absorb heat and reduce the temperature of waste heat generated by cooking in a kitchen and then discharge the waste heat into a room, and the temperature of the kitchen is effectively reduced; therefore, the range hood having an internal circulation filter has the advantages of being simple in structure, simple to use, safe, convenient, free of cleaning, not prone to blocking, good in fume filtering effect, free of peculiar smell of exhaust gas after filtering, environment-friendly, capable of reducing troubles of disassembling and washing the range hood, low in cost and the like, and it extends the service life of the range hood, thoroughly purifies the oil smoke gas, effectively absorbs excess heat in a kitchen, thereby lowering the internal ambient temperature of the kitchen, and greatly meets the living requirements of different families.

BRIEF DESCRIPTION OF ACCOMPANYING DRAWINGS

In the accompanying drawings, 1 refers to back cover, 2 refers to suction block, 3 refers to blower, 4 refers to filtration device, 5 refers to internal circulation block, 6 refers to filtration tank, 7 refers to air drum connection pipe, 8 refers to filtration box, 9 refers to liquid-proof batten, 10 refers to baffle blocks, 11 refers to one-way air curtain, 15 refers to blower wheel chassis, 16 refers to air drum, 17 refers to water filling pipe, and 18 refers to liquid-discharge valve port.

SPECIFIC DESCRIPTION OF THE PREFERRED EMBODIMENT

Embodiment 1

Figure 1:
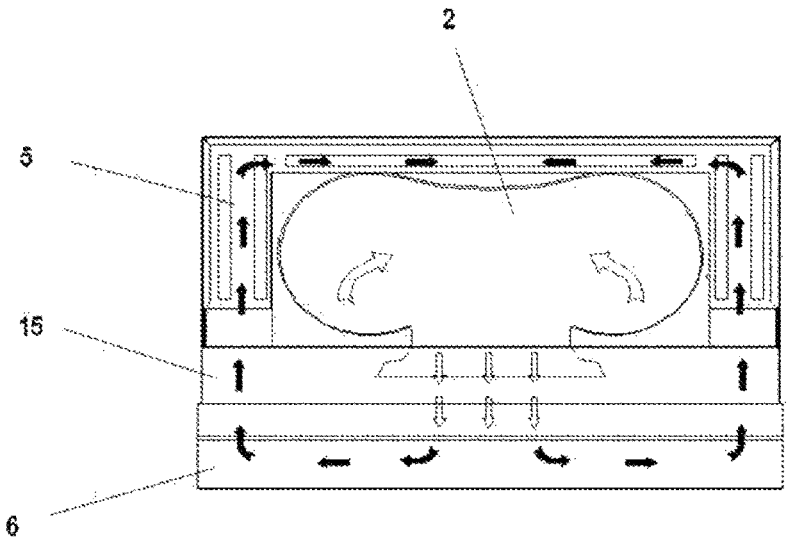
FIG. 1 is a schematic diagram showing the cooking fumes filtration and internal circulation flow of a range hood having an internal circulation filter for cooking fumes in embodiment 1 of the invention.
Figure 2:
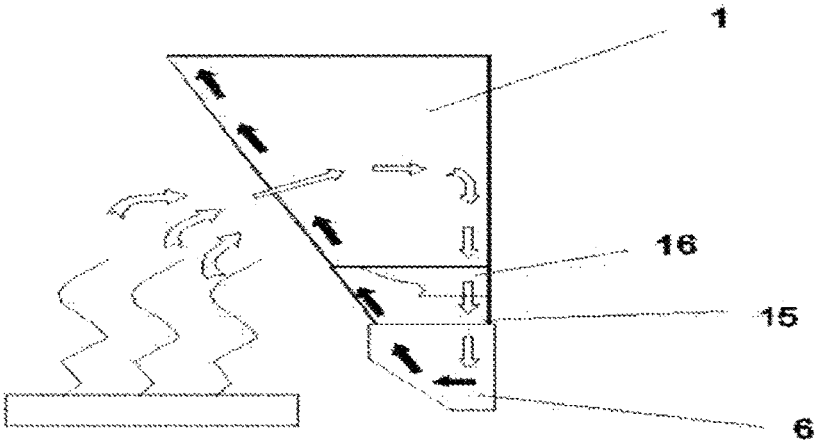
FIG. 2 is a left view of FIG. 1 adding gas stove.
Figure 3:
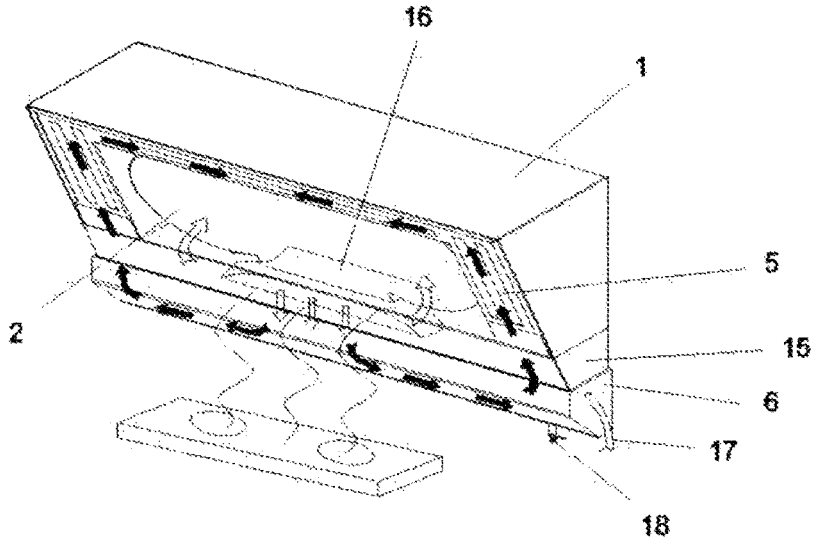
FIG. 3 is a space diagram of FIG. 1 adding gas stove.
Figure 4:
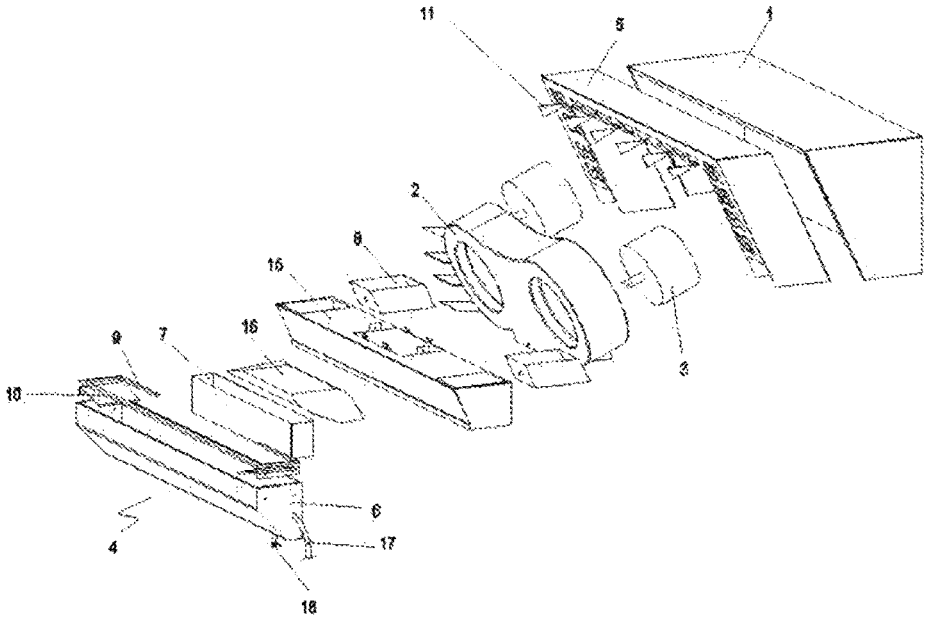
FIG. 4 is an exploded view of a range hood having an internal circulation filter for cooking fumes in embodiment 1 of the invention.

As shown in FIGS. 1, 2, 3, and 4, a range hood having an internal circulation filter for cooking fumes in embodiment 1 comprises a back cover 1, a suction block 2 is provided inside the back cover, and a blower 3 provided inside the suction block is used to achieve adsorption of cooking fumes, the back cover is further provided with a filtration device 4 in communication with an air outlet of the blower, and used to filter the cooking fumes, an internal circulation block 5 is connected and sealed to an air outlet end of the filtration device 4 to achieve internal circulation of filtered gasses.

In the embodiment, circulating line (not shown in the drawings) connected with an air outlet end of the filtration device 4 is provided in the internal circulation block 5.

In the embodiment, the filtration device comprises a filtration tank 6 containing liquid to realize oil smoke filtration.

In the embodiment, blower wheel chassis 15 is provided below the suction block, an air drum 16, communicated with an air duct of the blower and used for guiding wind direction, is arranged inside the the blower wheel chassis, and an air drum connection pipe 7 is provided in the blower wheel chassis between the air drum and the filtration tank to realize the oil smoke enters the liquid in the filtration tank from the air drum.

In the embodiment, the blower wheel chassis is provided with a filtration box 8 between air outlet end of the filtration tank and air inlet end of the internal circulation block 5.

In the embodiment, a liquid-proof batten 9 is provided between the blower wheel chassis and the filtration tank to achieve isolation of blower wheel chassis from liquid contamination in filtration tank.

In the embodiment, baffle blocks 10 are provided on two sides of top portion of the filtration tank, which are used for preventing the liquid in the filtration tank from splashing caused by overlarge air inlet amount of the blower and isolating the oil concentrated on the two sides of the filtration tank from the water in the middle.

In the embodiment, the internal circulation block is provided with one-way air curtain 11 used for separating air outside the range hood body and gas in the internal circulation block of the range hood.

In the embodiment, the liquid contained in the filtration tank is water.

In the embodiment, the filtration tank is provided with a liquid-discharge valve port 18 for removing oil and sewage and a water filling pipe 17 for injecting new water into the filtration tank.

In the embodiment, the liquid in the filtration tank is mixed with more than one of the deodorant, detergent or degreaser, or any other additives capable of achieving the same cleaning and filtering functions of smell removal, oil removal and the like can be adopted; in the same way, a filter (not shown in the drawings) for removing smell and/or removing oil can be arranged in the filtration box, the same function or the the secondary optimization function can be achieved.

The above description is merely preferred embodiment of the invention, and is not intent to limit the technical scope of the invention in any way. Any simple modification, equivalent change and modification of the above embodiments according to the technical essence of the invention are still within the scope of the technical solution of the invention.

The invention claimed is:

1. Range hood having an internal circulation filter for cooking fumes, comprising a back cover (1), a suction block (2) is provided inside the back cover (1), and a blower (3) provided inside the suction block (2);

wherein the back cover (1) is further provided with a filtration device (4) in communication with an air outlet of the blower (3), and an internal circulation block (5) is connected and sealed to an air outlet end of the filtration device (4);

circulating line connected with an air outlet end of the filtration device (4) is provided in the internal circulation block (5); and the filtration device (4) comprises a filtration tank (6) for containing liquid;

wherein blower wheel chassis (15) is provided below the suction block (2), an air drum (16) is arranged inside the the blower wheel chassis (15), an air inlet of the air drum (16) is connected to an air outlet of the blower (3), an air outlet of the air drum (16) is connected to the filtration tank (6) through an air drum connection pipe (7).

2. The range hood having an internal circulation filter for cooking fumes of claim 1, wherein the blower wheel chassis (15) is provided with a filtration box (8) between air outlet end of the filtration tank (6) and air inlet end of the internal circulation block (5).

3. The range hood having an internal circulation filter for cooking fumes of claim 2, wherein a filter is provided in the filtration box (8); the liquid in the filtration tank (6) is mixed with more than one of the deodorant, detergent or degreaser.

4. The range hood having an internal circulation filter for cooking fumes of claim 2, wherein a liquid-proof batten (9) is provided between the blower wheel chassis (15) and the filtration tank (6).

5. The range hood having an internal circulation filter for cooking fumes of claim 4, wherein baffle blocks (10) are provided on two sides of top portion of the filtration tank (6).

6. The range hood having an internal circulation filter for cooking fumes of claim 5, wherein the internal circulation block (5) is provided with one-way air curtain (11).

7. The range hood having an internal circulation filter for cooking fumes of claim 6, wherein the liquid contained in the filtration tank (6) is water.

8. The range hood having an internal circulation filter for cooking fumes of claim 7, wherein the filtration tank (6) is provided with a liquid-discharge valve port (18) and a water filling pipe (17).

* * * * *